US008043064B2

(12) United States Patent
Huang et al.

(10) Patent No.: US 8,043,064 B2
(45) Date of Patent: Oct. 25, 2011

(54) FAN AND FAN WHEEL THEREOF

(75) Inventors: Jing-Cao Huang, Dong-Guan (CN); Chui Chu, Dong-Guan (CN); Yi-Liang Gong, Dong-Guan (CN); Kevin Yu, Dong-Guan (CN)

(73) Assignee: Delta Electronics, Inc., Taoyuan Hsien (TW)

( * ) Notice: Subject to any disclaimer, the term of this patent is extended or adjusted under 35 U.S.C. 154(b) by 486 days.

(21) Appl. No.: 12/355,335

(22) Filed: Jan. 16, 2009

(65) Prior Publication Data

US 2010/0124505 A1 May 20, 2010

(30) Foreign Application Priority Data

Nov. 18, 2008 (TW) ..... 97220635 U

(51) Int. Cl.
*F04D 29/38* (2006.01)

(52) U.S. Cl. ..... 416/223 R; 415/220; 416/243

(58) Field of Classification Search ..... 416/223 R, 416/243, 238; 415/22, 222, 223
See application file for complete search history.

(56) References Cited

U.S. PATENT DOCUMENTS 4,218,188 A * 8/1980 Saterdal ..... 416/172
4,373,861 A * 2/1983 Papst et al. ..... 415/218.1
4,470,753 A * 9/1984 Witzel ..... 415/116
4,515,511 A * 5/1985 Heerlein ..... 416/131
4,564,335 A * 1/1986 Harmsen et al. ..... 415/218.1
5,664,282 A * 9/1997 Castwall et al. ..... 15/319

* cited by examiner

*Primary Examiner* — Gary F. Paumen
(74) *Attorney, Agent, or Firm* — Grossman, Tucker, Perrault & Pfleger, PLLC

(57) ABSTRACT

A fan and a fan wheel thereof are provided. The fan comprises the fan wheel and a fan cowl. The fan wheel comprises a hub and a plurality of blades. The hub can define an axial direction and a radial direction, and each of the blades has an axial length and a radial length. The portion of each of the blades that extends along the axial direction over a top edge of a side wall of the hub accounts for the axial length in a ratio between one third and two thirds. A connection portion connecting a central portion to the side wall of the hub, and a tip and a tail of each of the blades, as well as a flow conducting portion connecting a top wall to a central hole of the fan cowl, are all rounded. Thereby, the fan and the fan wheel thereof can strengthen the flow rate and reduce the noise generated by the fan.

15 Claims, 7 Drawing Sheets

FAN AND FAN WHEEL THEREOF

This application claims priority to Taiwan Patent Application No. 097220635 filed on Nov. 18, 2008, the disclosure of which is incorporated herein by reference in its entirety.

CROSS-REFERENCES TO RELATED APPLICATIONS

Not applicable.

BACKGROUND OF THE INVENTION

1. Field of the Invention

The present invention relates to a fan and a fan wheel thereof, and more particularly, the present invention relates to a fan and a fan wheel thereof capable of reducing the noise while increasing the air flow rate.

2. Descriptions of the Related Art

As a result of the advancement in process technologies, circuit boards of many electronic products are now made to carry electronic components (e.g., central processing units, memories, integrated circuits and the like) at an ever-higher density. Because electronic components generate heat during operation, denser electronic components increases the temperature of the whole electronic product, which may cause abnormal operation of the electronic products or even damage to the electronic components thereof due to intense heat.

In the prior art, a fan is disposed in an electronic product so that air flow produced by the rotating fan can force convection to cool the electronic components thereof.

FIG. 1 illustrates a conventional fan 1 that comprises a fan wheel 11 and a fan cowl 12. The fan wheel 11 comprises a hub 110 and a plurality of blades 111. Each of the blades 111 has a blade width W1 and extends from a side wall of the hub 110.

The conventional fan 1 has a narrower blade width W1, and to maintain certain efficiency in producing the air flow, a large number of blades must be provided. For instance, the conventional fan 1 depicted in FIG. 1 comprises seven blades 111. As a result, the pitch between the blades 111 is inevitably reduced. Moreover, to get a strengthened flow rate and improved heat dissipation efficiency, the rotation speed of the fan wheel 11 must be increased. However, when the fan 1 operates at a high rotation speed, there is too small of a pitch between the blades which will cause disturbance to the air flow fields produced by the blades to each other or even cause annoying noise.

According to the above description, the conventional fan 1 increases the rotational speed of the fan wheel 11 at the cost of exacerbated noise. On the other hand, if the rotational speed of the fan wheel 11 is not increased, the flow rate would be too small, which would be inadequate to deliver the desired heat dissipation efficiency for the dense electronic components.

In view of this, it is highly desirable in the art to provide a fan and a fan wheel thereof capable of reducing the noise while increasing the airflow rate.

SUMMARY OF THE INVENTION

The objective of this invention is to provide a fan and a fan wheel thereof capable of increasing the airflow rate and reducing the noise.

The fan of this invention comprises a fan wheel and a fan cowl. The fan cowl comprises a top wall, a flow conducting portion, a central hole and a receiving space. The receiving space is adapted to receive the fan wheel, while the central hole pneumatically connects the receiving space with the ambience. The flow conducting portion is rounded to extend downwards from the top wall to the central hole to enhance the air flow.

The fan wheel comprises a hub and a plurality of blades. The hub has a central portion, a side wall annularly disposed around the central portion, and a connection portion. The side wall has a top edge, a bottom edge opposite to the top edge and an outer surface between the top edge and the bottom edge. The hub defines an axial direction and a radial direction. Each of the blades has an axial length and a radial length, and extends outward along the radial direction and the axial direction sequentially from the outer surface of the side wall to form a tip above the top edge and a tail extending at least along the radial direction from the outer surface. Each of the blades is gradually broadened from the tip to the tail, with the tip and the tail are curved.

The portion of each of the blades extending beyond the top edge along the axial direction accounts for substantially between one third and two thirds of the axial length, and the portion of each of the blades extending beyond the bottom edge along the axial direction accounts for substantially between zero and one third of the axial length.

With the above structure, the fan and the fan wheel thereof of this invention is adapted to increase the airflow rate and operate at a decreased rotation speed to reduce the noise produced during operation. As a result, inadequate cooling capacity and loud noise during operation with the conventional fan are prevented.

The detailed technology and preferred embodiments implemented for the subject invention are described in the following paragraphs accompanying the appended drawings for people skilled in this field to well appreciate the features of the claimed invention.

DESCRIPTION OF THE PREFERRED EMBODIMENT

Embodiments to be described hereinafter are only intended to illustrate rather than to limit this invention. It should be appreciated that in the following embodiments and attached drawings, elements unrelated to this invention are omitted from depiction; and for ease of understanding, dimensional scales among individual elements are exaggerated and not necessarily identical to those of the practical products.

Figure 1:
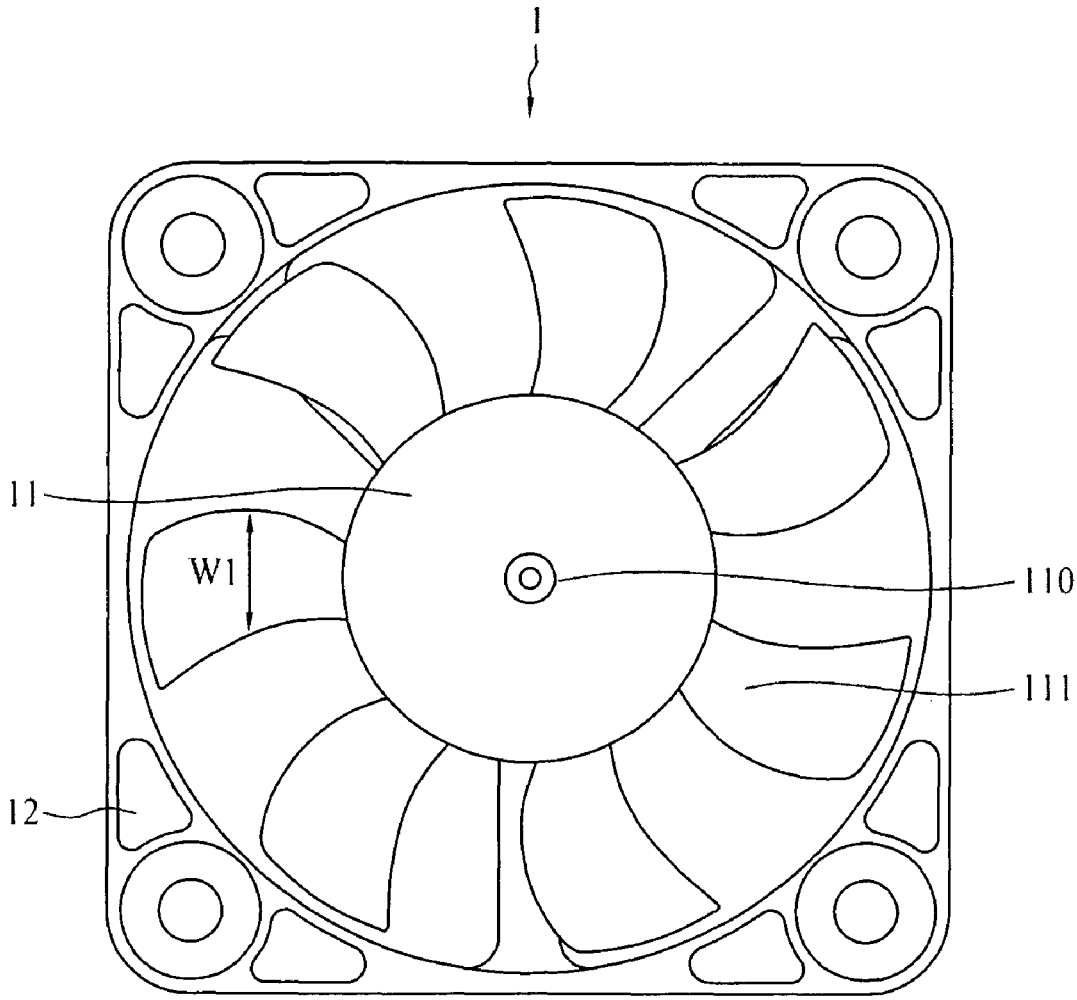
FIG. 1 (Prior Art)
FIG. 1 is a schematic top view of the conventional fan.
Figure 2A:
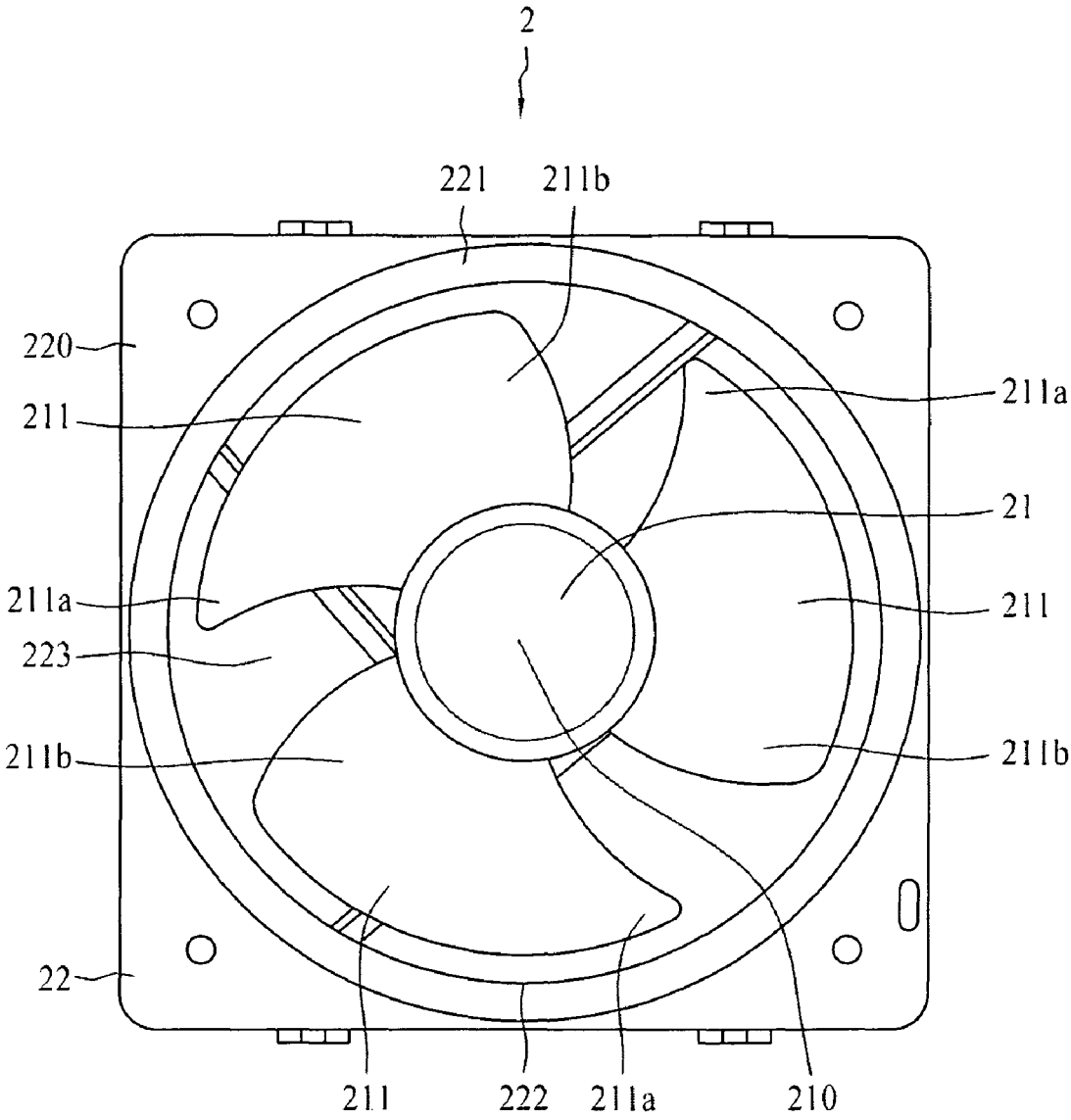
FIG. 2A is a schematic top view of the fan of this invention.
Figure 2B:
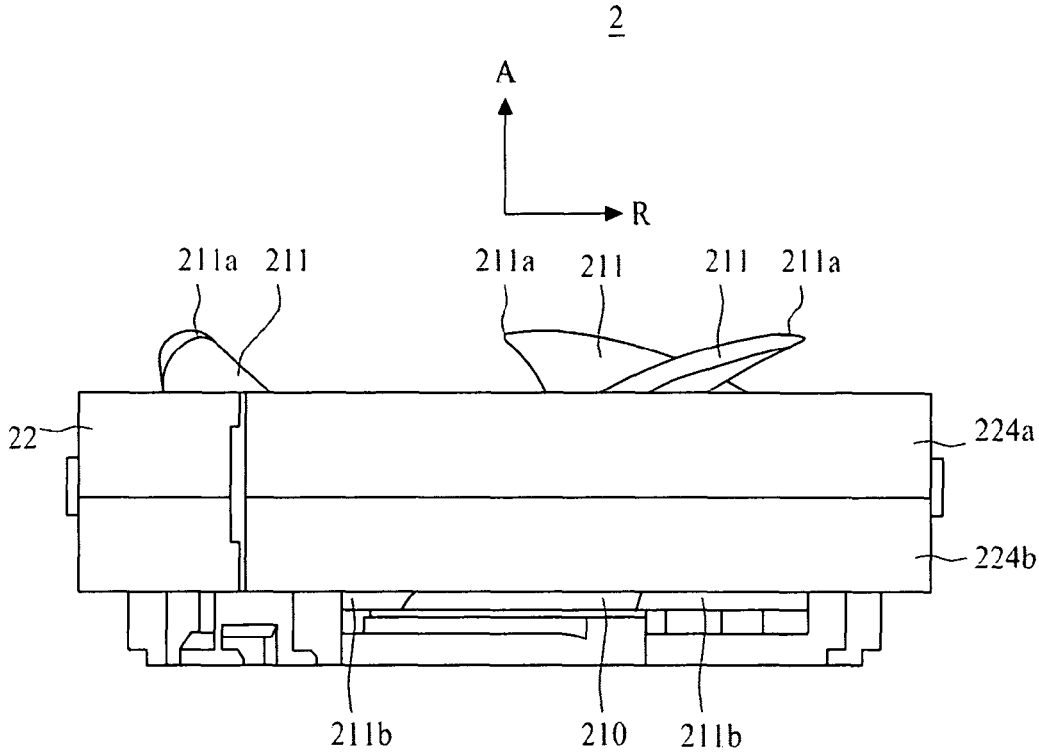
FIG. 2B is a schematic side view of the fan of this invention.

FIGS. 2A and 2B illustrate the schematic top view and the schematic side view of a fan 2 according to this invention respectively therein. The fan 2 comprises a fan wheel 21 and a fan cowl 22. The fan cowl 22 is adapted to receive the fan wheel 21 and guide the air flow.

The fan wheel 21 comprises a hub 210 and a plurality of fan blades 211. The hub 210 defines an axial direction A and a radial direction R. Each of the blades 211 has a tip 211*a* and a tail 211*b*. The hub 210 and the blades 211 are formed integrally to facilitate the production. As shown in FIG. 2B, the portion of each blade 211 extending beyond the fan cowl 22 along the axial direction A helps to increase the flow rate of the fan 2, thereby preventing a high rotational speed and reduce the resulting noise. The structures of the fan wheel 21 and the fan cowl 22 will be detailed hereinbelow.

Figure 3A:
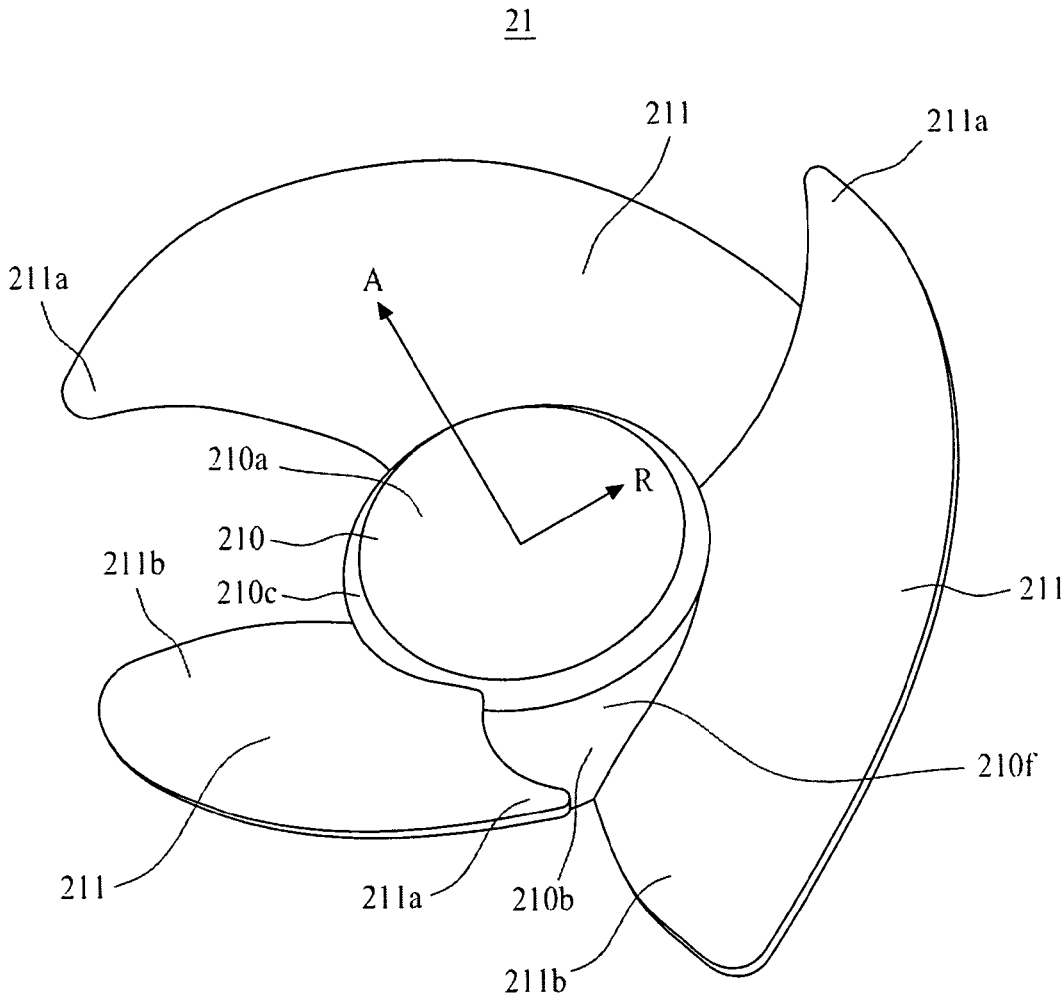
FIG. 3A is a schematic perspective view of the fan wheel of this invention.
Figure 3B:
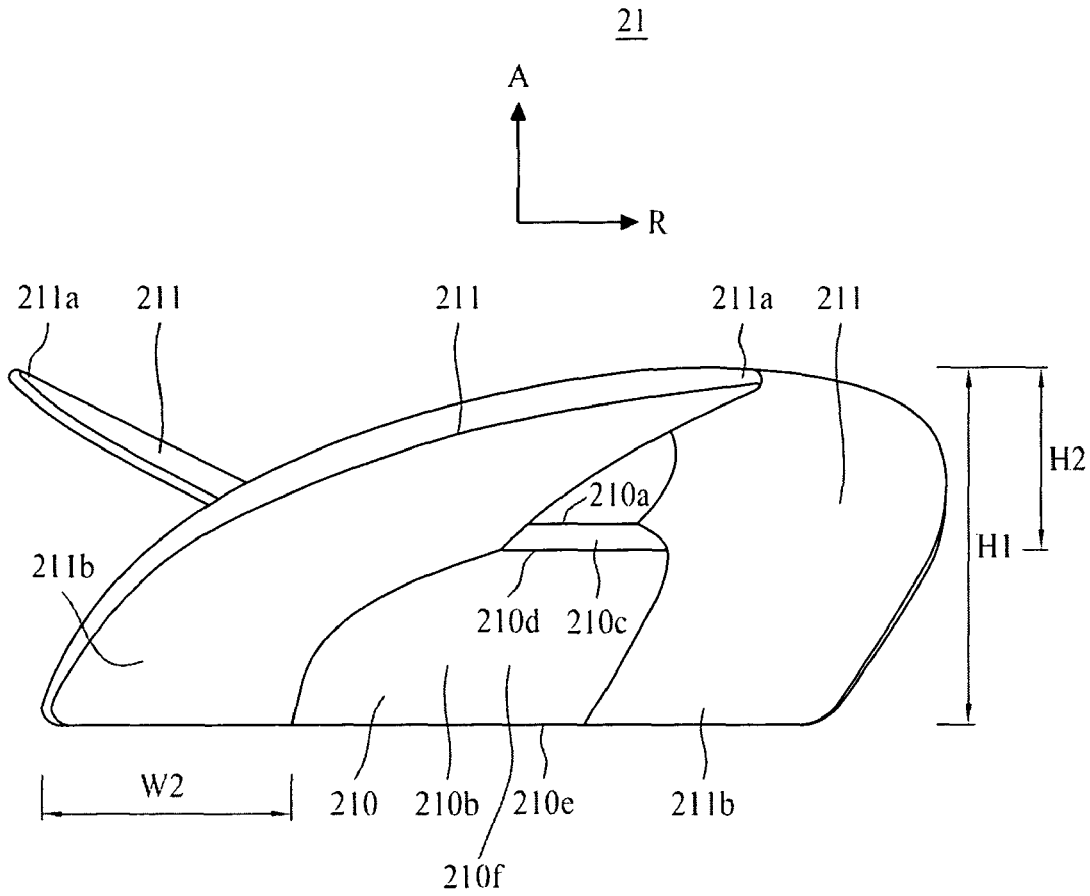
FIG. 3B is a schematic side view of the fan wheel of this invention.

FIGS. 3A and 3B illustrate the schematic perspective view and the schematic side view of the fan wheel 21 respectively. The hub 210 has a central portion 210*a*, a side wall 210*b* annularly disposed around the central portion 210*a*, and a connection portion 210*c*. The side wall 210*b* has a top edge 210*d*, a bottom edge 210*e* opposite to the top edge 210*d* and an outer surface 210*f* between the top edge 210*d* and the bottom edge 210*e*. It should be noted that the connection portion 210*c* is rounded and connects the central portion 210*a* with the top edge 210*d* of the side wall 210*b*. Through the rounded design of the connection portion 210*c*, the air flow near the connection portion 210*c* is made smoother and the air intake area of the fan 2 is increased. A plurality of reinforcing ribs (not shown) is further disposed on the inner surface of the hub 210 to reinforce the strength of the fan wheel 21 so that the fan 2 can operate stably.

As shown in FIGS. 3A and 3B, a radial dimension W2 of each of the blades 211 in this invention is enlarged to increase the flow rate produced by each of the blades 211. Hence, the number of the blades 211 can be decreased. In this embodiment, the number of the blades 211 is three. Accordingly, during the operation of the fan 2, the disturbance of the air flows driven by the individual blades 211 to each other is minimized with reduced noise generation and improved heat dissipation efficiency.

In more detail, each of the blades 211 extends outwards along the radial direction R and the axial direction A from the outer surface 210*f* of the side wall 210*b* to form a tip 211*a* above the top edge 210*d* and a tail 211*b* extending at least along the radial direction R from the outer surface 210*f*. Each of the blades 211 is bent from the tip 211*a* towards the tail 211*b*. As shown in FIGS. 3A and 3B, each of the blades 211 of this invention is gradually broadened from the tip 211*a* to the tail 211*b* to increase the flow rate and air pressure of the fan 2. To mitigate the air flow disturbance between the blades 211 and the fan cowl 22 in the radial direction R and the accompanying noise, both the tip 211*a* and the fan cowl 211*b* are curved. In addition, each of the blades 211 has at least one portion of its periphery rounded to reduce the air disturbance around the blade 211, thereby further mitigating the noise generation. The rounded design makes the injection molding and demolding of the blades 211 and the hub 210 easier, and the production of the mold for producing the fan wheel 21 is also made easier because of the elimination of sharp corners. Consequently, the overall production cost is lowered and the production yield is increased.

In reference to FIG. 3B, each of the blades 211 has a radial dimension W2 and an axial dimension H1. The portion of each of the blades 211 extending beyond the top edge 210*d* along the axial direction A has a dimension H2 accounting for substantially between one third and two thirds of the axial length H1, which remarkably enlarges the area of the blade 211 for producing the air flow. Preferably, the dimension H2 of the portion extending beyond the top edge 210*d* accounts for substantially one half of the axial length H1. For example, if the axial length H1 of each of the blades 211 is substantially 3.6 cm, the dimension H2 of the portion extending beyond the top edge 210*d* is substantially 1.97 cm. Furthermore, the portion of each of the blades 211 extending beyond the top edge 210*d* along the axial direction A has an area larger than the area of the portion of the blade below the top edge 210*d*, so the air intake area of the fan 2 is increased and the portion of each of the blades 211 above the top edge 210*d* can suck in or discharge the air along the radial direction R without the interference from the hub 210, thus remarkably improving the air flow smoothness and enlarging the air intake/discharging area.

Each of the blades 211 may also extend beyond the bottom edge 210*e* along the axial direction A to enlarge the area of the blade 211 for producing the air flow. The portion extending beyond the bottom edge 210*e* may account for substantially between zero and one third of the axial dimension H1. In this embodiment, the portion of each of the blades 211 extending beyond the bottom edge 210*e* along the axial direction A accounts for substantially a zero percentage of the axial dimension H1.

In reference to FIG. 2B again, the tips 211*a* and the tails 211*b* of the fan 2 further extend upwards beyond the side wall 224*a* and downwards beyond the side wall 224*b* of the fan cowl 22 along the axial direction A. This helps to prevent the fan cowl 22 from disturbing the rotating blades 211 in producing the air flow, so that the portion(s) of each of the blades 211 extending upwards or downwards beyond the fan cowl 22 can suck in or discharge the air along the radial direction R, thus remarkably improving the air flow smoothness and enlarging the air intake/discharging area. However, those of ordinary skill in the art may design each of the blades 211 to extend only upwards beyond the side wall 224*a* or only downwards beyond the side wall 224*b* depending on practical needs, and no limitation is made herein.

Figure 4:
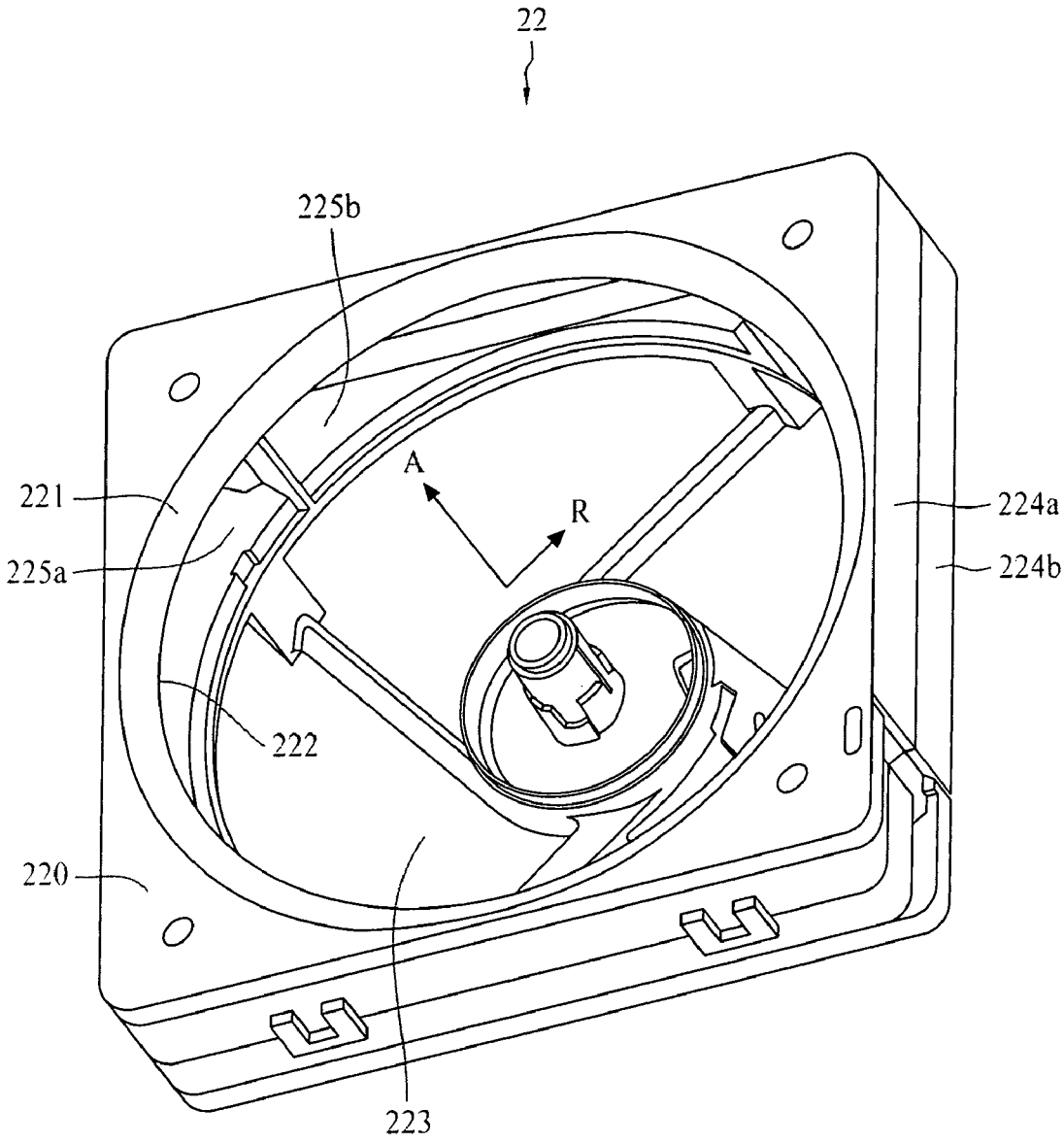
FIG. 4 is a schematic perspective view of the fan cowl of this invention.

FIG. 4 illustrates a detailed construction of the fan cowl 22 of this invention. In this embodiment, the fan cowl 22 is formed of an upper portion and a lower portion in combination, and has a top wall 220, a flow conducting portion 221, a central hole 222, a receiving space 223 and side walls 224*a*, 224*b*. The receiving space 223 of the fan cowl 22 is adapted to receive the fan wheel 21, while the central hole 222 pneumatically connects the receiving space 223 with the ambience and exposes the fan wheel 21. Preferably, a clearance (not shown) should be tightened between the bottom of the fan wheel 21 and the fan cowl 22 to provide the fan 2 with a water-proof function. The flow conducting portion 221 of the fan cowl 22 is rounded to extend downwards from the top wall 220 to the central hole 222, which can improve the smoothness of the air flow sucked in or discharged from the fan cowl 22, thereby reducing the noise and increasing the flow rate of the fan 2 during operation.

In reference to FIG. 4, the fan cowl 22 may be further have a plurality of flow conducting grooves 225*a*, 225*b*. The flow conducting grooves 225*a*, 225*b* pneumatically connect the receiving space 223 to guide the air flow. This can inhibit the loss of the air flow at the fan cowl 22 along the radial direction R when the blades 211 are rotating, thereby strengthening the air pressure and making the flow field within the fan smoother. It should be noted that although only two flow conducting grooves 225*a*, 225*b* are depicted in FIG. 4 as restricted by the viewing angle, this invention has no limitation on the number of flow conducting grooves 225*a*, 225*b*.

Figure 5:
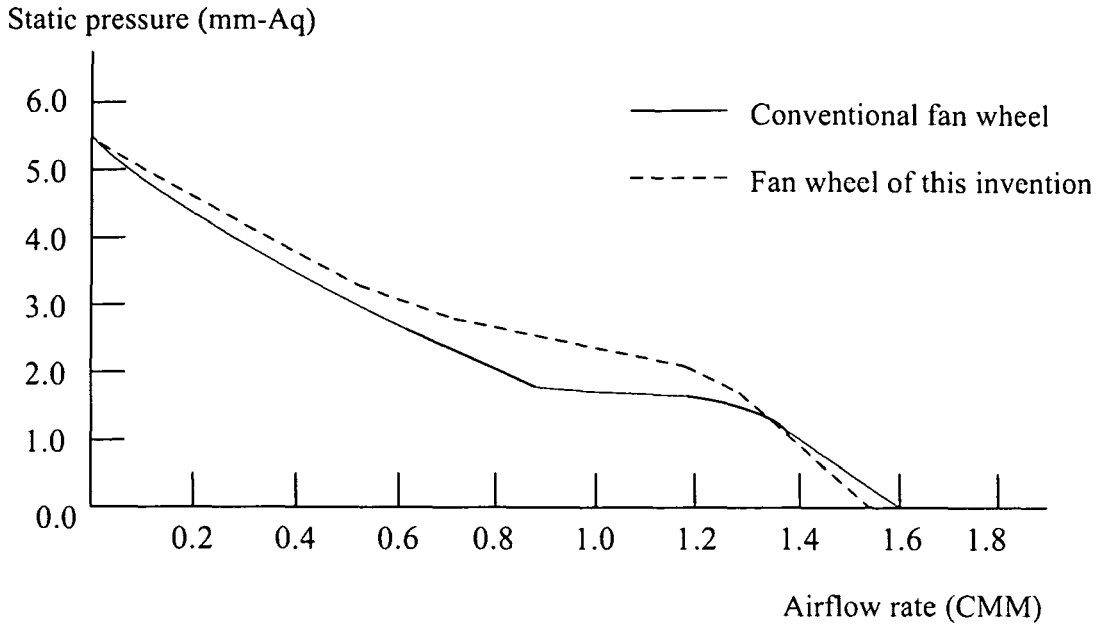
FIG. 5 is a graph illustrating performance of the fan of this invention versus the conventional fan.

FIG. 5 illustrates a graph of the performance of the fan 2 of this invention versus a conventional fan of a similar size. The horizontal axis represents the airflow rate in units of cubic meter per minute (CMM), while the vertical axis represents the static pressure in units of millimeter aqua (mm-Aq). In this embodiment, for the fan under the performance measurement, the fan wheel 21 has a radius of 4.6 cm, the hub 210 has a radius of 1.86 cm, each of the blades 211 has an axial dimension H1 of 3.6 cm and a radial dimension W2 of 2.74 cm, and the portion of each of the blades 211 extending beyond the top edge 210*d* of the hub 210 has a dimension of 1.97 cm. Furthermore, the fan cowl 22 has a width of substantially 11.3 cm, the central hole 222 has a diameter of 10 cm, the flow conducting portion 221 has an outer diameter of 11.2 cm, the two side walls 224*a*, 224*b* measure an overall height of 2.8 cm, and each of the blades 211 extends beyond the two side walls 224*a*, 224*b* along the axial direction A by a total length of 0.67 cm. In FIG. 5, the performance curve of the fan 2 of this invention is denoted by a dashed line, while that of the conventional fan is denoted by a solid line. It can be seen from FIG. 5 that within an airflow rate range of 0.6 CMM to 1.2 CMM, the fan 2 of this invention delivers a significantly higher airflow rate than the conventional fan at the same static pressure. In addition, the fan 2 of this invention delivers a significantly higher static pressure than the conventional fan at the same airflow rate. Hence, as compared to the prior art, both the airflow rate and the air pressure produced by the fan 2 of this invention are positively improved.

According to the above descriptions, by broadening the blades and extending the blades beyond the hub and the fan cowl along the axial direction, this invention provides increased air pressure and airflow rate, thereby preventing from an increased high rotational speed for enhancing heat dissipation efficiency and generating excess noise. In addition, the number of blades is reduced, and the peripheries of the blades, the connection portion of the hub and the flow conducting portion of the fan cowl are designed to be rounded, which further makes the airflow path smoother and thus reduces noise produced by the fan 2 during operation.

The above disclosure is related to the detailed technical contents and inventive features thereof. People skilled in this field may proceed with a variety of modifications and replacements based on the disclosures and suggestions of the invention as described without departing from the characteristics thereof. Nevertheless, although such modifications and replacements are not fully disclosed in the above descriptions, they have substantially been covered in the following claims as appended.

What is claimed is:

1. A fan wheel, comprising:

a hub defining an axial direction and a radial direction, the hub having a central portion, a side wall annularly disposed along the central portion, and a connection portion, in which the side wall has a top edge, a bottom edge opposite to the top edge and an outer surface between the top edge and the bottom edge, and the connection portion is rounded to connect the central portion and the top edge of the side wall; and a plurality of blades, each of the blades having an axial length and a radial length and extending outward along the radial direction and the axial direction sequentially from the outer surface of the side wall to form a tip above the top edge and a tail extending at least along the radial direction from the outer surface, in which each of the blades is gradually broadened from the tip to the tail, and the tip and the tail are curved;

wherein the portion of each of the blades extending beyond the top edge along the axial direction accounts for substantially between one third and two thirds of the axial length, and the portion of each of the blades extending beyond the bottom edge along the axial direction accounts for substantially between zero and one third of the axial length.

2. The fan wheel as claimed in claim 1, wherein the portion of each of the blades extending beyond the top edge along the axial direction accounts for substantially one half of the axial length, and the portion of each of the blades extending beyond the bottom edge along the axial direction accounts for substantially a zero percentage of the axial length.

3. The fan wheel as claimed in claim 2, wherein the surface area of the portion of each of the blades extending beyond the top edge along the axial direction is greater than the surface area of the portion of each of the blades below the top edge.

4. The fan wheel as claimed in claim 3, wherein the blades comprise three blades.

5. The fan wheel as claimed in claim 3, wherein the hub is formed integrally with the blades.

6. The fan wheel as claimed in claim 3, wherein each of the blades is curved downward from tip to tail.

7. The fan wheel as claimed in claim 3, wherein each of the blades has a periphery and at least one portion of the periphery is rounded.

8. A fan, comprising:

a fan wheel as claimed in claim 1; and a fan cowl comprising a top wall, a flow conducting portion, a central hole and a receiving space, wherein the receiving space receives the fan wheel, the central hole pneumatically connects the receiving space with the ambience, and the flow conducting portion is rounded to extend downward from the top wall to the central hole.

9. The fan as claimed in claim 8, wherein the portion of each of the blades extending beyond the top edge along the axial direction accounts for substantially one half of the axial length, and the portion of each of the blades extending beyond the bottom edge along the axial direction accounts for substantially a zero percentage of the axial length.

10. The fan as claimed in claim 9, wherein the surface area of the portion of each of the blades extending beyond the top edge along the axial direction is greater than the surface area of the portion of each of the blades below the top edge.

11. The fan as claimed in claim 10, wherein the blades comprises three blades.

12. The fan as claimed in claim 10, wherein each of the blades has a periphery and at least one portion of the periphery is rounded.

13. The fan as claimed in claim 10, wherein the fan cowl has at least one side wall, and the blades of the fan wheel extend beyond the at least one side wall of the fan cowl upward along the axial direction.

14. The fan as claimed in claim 10, wherein the fan cowl has at least one side wall, and the blades of the fan wheel extend beyond the at least one side wall of the fan cowl downward along the axial direction.

15. The fan as claimed in claim 10, wherein the fan cowl is formed with a plurality of flow conducting grooves pneumatically connecting the receiving space.

* * * * *